US005666936A

United States Patent [19]

Estrada

[11] Patent Number: 5,666,936

[45] Date of Patent: Sep. 16, 1997

[54] ERGONOMIC INERTIA BOWSTRING RELEASE

[76] Inventor: Felix M. Estrada, 2306 N. MacArthur #1032, Irving, Tex. 75062

[21] Appl. No.: 518,557

[22] Filed: Nov. 16, 1995

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 3,965,884 | 6/1976 | Killian | 124/35.2 |
| 4,156,417 | 5/1979 | Fletcher | 124/35.2 |
| 4,567,875 | 2/1986 | Fletcher | 124/35.2 |
| 4,719,908 | 1/1988 | Pellis | 124/35.2 |
| 4,823,761 | 4/1989 | Lewis | 124/35.2 |
| 4,854,293 | 8/1989 | Roberts | 124/35.2 |
| 5,025,772 | 6/1991 | Stevenson | 124/35.2 |
| 5,031,600 | 7/1991 | Moore | 124/35.2 |
| 5,067,472 | 11/1991 | Vogel et al. | 124/35.2 |

*Primary Examiner*—John A. Ricci

[57] ABSTRACT

An archery bowstring release comprises a base grip member which is held vertically in use, the base grip member including an interior vertical cavity which intersects a slot which opens to three sides of the base grip member. A body member is slidably inserted into the slot and pivotally held by a fastener which is inserted through the vertical cavity. The body member includes an upper and a lower flange which extend toward the bowstring. A bowstring catch lever including a bowstring retaining hook is pivotally attached between the flanges at the forward end of the body member. A pawl lever is pivotally attached between the flanges; the pawl lever including a forward branch which selectively locks and releases the bowstring catch lever, and a rearward branch which extends into the slot in the base grip member and is pivotal to extend out one of the sides of the body member. A tip grip member is pivotally attached to the base grip member about a horizontal axis. When an archer grips the base grip member and tip grip member, the tip grip member will contact the pawl lever, which will lock the bowstring catch lever to retain the bow string; when the archer relaxes the grip on the base grip member and tip grip member, the pawl lever will be allowed to pivot to release the bow string.

9 Claims, 3 Drawing Sheets

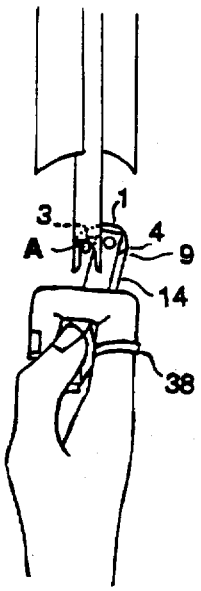
FIG. 5A
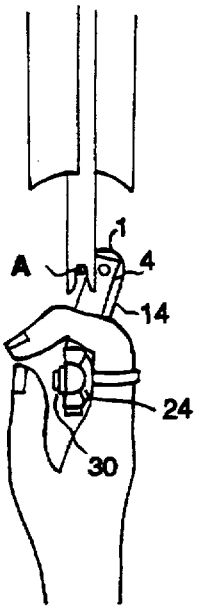
FIG. 5B
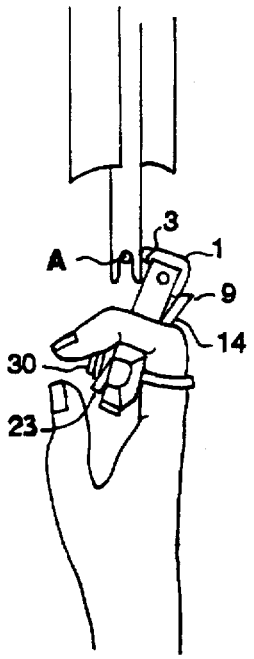
FIG. 5C
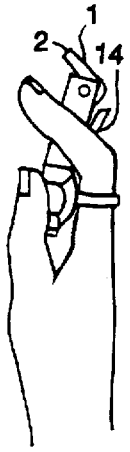
FIG. 5D
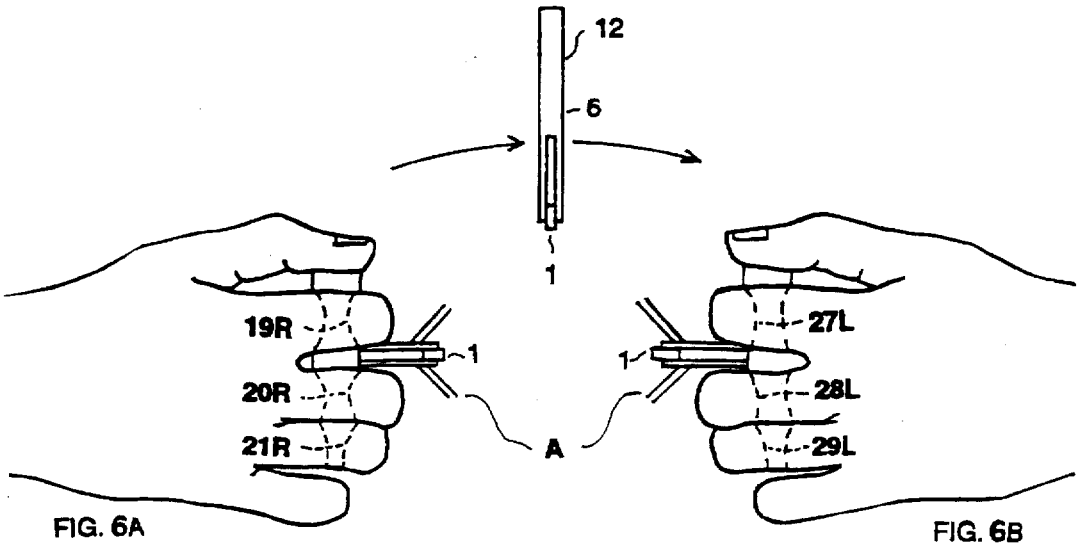
FIG. 6A
FIG. 6B

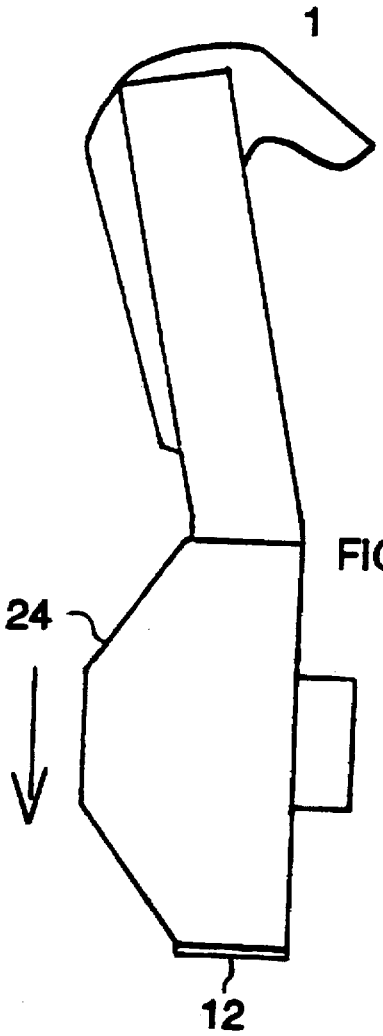
FIG. 7A
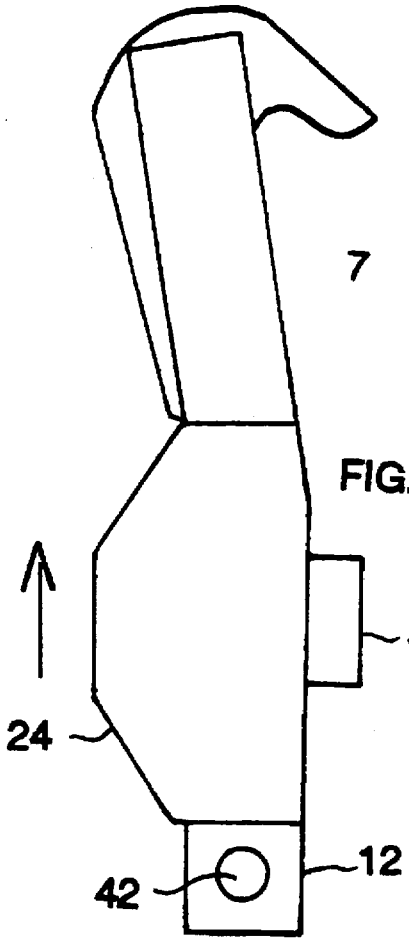
FIG. 7B
FIG. 7

ERGONOMIC INERTIA BOWSTRING RELEASE

BACKGROUND OF THE INVENTION

1. Field of the Invention

The present invention relates in general to archery devices and more particularly to a novel ergonomic inertia response device to effect an archers aesthetic, original and conventional manner of drawing and releasing a tensioned bowstring without a trigger or depress means to shoot a bow and arrow.

2. Prior Art

The long history of the use of the bow and arrow has evolved into the present day use of high-tech designs and materials which have allowed for the fabrication of the bow and bowstring of sufficient strength to maximize the force imparted upon the arrow when it is shot from a modern bow. As the strength of the bow is increased, there is a direct increase in the force required to draw the bowstring before the arrow is shot. Said increase of bow strength has produced a major problem for the shooters fingers being used to draw the relatively thin bowstring construction because of the often unbearable pressures imposed upon the fingers at areas of contact. Conventionally, the bare fingers are used to pull rearward on a bowstring, thereafter released by quickly straightening said fingers which causes the bowstring to torque as it rolls frictionally over the fleshly portion of the fingers or glove material or tab material causing said bowstring to be deflected and to unwind itself after release resulting in loss of shooting accuracy. Very few archers can consistently straighten their fingers quickly and cleanly enough to clear the path of said bowstring without creating previously mentioned problems as well as receiving painful fingertips and fatigued muscles of the drawing hand which in turn may cause another problem, that of distracting the archer from quality practice time due to sore fingers and muscles.

Various forms of mechanical release devices are popular with most archers chiefly because said devices significantly increase finger comfort and aiming time resulting in increased accuracy. Thus, the device users greatly outnumber the conventional bare fingers users. But quite often enough, the device user tries the bare fingers method and after a period of sore fingers and loss of accuracy the archer returns to the device again. The bare fingers user prefers an original, aesthetic and conventional bare fingers manner using a fingers tab or a glove to cushion said fingers in order to shoot a bow and arrow in tournaments and during hunting season. Said fingers user will find that the prior art devices require by their function and design a totally different method of drawing, aiming, and releasing the bowstring. It also, requires the commitment to use only the device which prohibits its use even only for practice sessions due to its operation which cannot be utilized in the conventional bare fingers shooting of a bow and arrow. Therefore, said fingers user prefers to not use a device.

An example of a device that uses a thumb depress means is shown in U.S. Pat. No. 4,105,011. A device that requires the index finger to pull a trigger are shown in U.S. Pat. Nos. 5,184,596 and 5,020,508. Still another uses a plunger, (U.S. Pat. No. 2,488,597). While another uses a pulling pin (U.S. Pat. No. 4,574,767) in an awkward attempt to achieve flawless release of a drawn bowstring while spoiling archery's original and aesthetic manner of shooting a bow and arrow.

Aforementioned devices either by their structural form or function tend to have other disadvantages due to their complex operation and construction using various forms of movable members. Said devices will tend to debilitate hand-eye coordination used to shoot a bow and arrow in an original, aesthetic and conventional manner. Said debilitated hand eye coordination may cause an undesirable flinching or punching of the shot resulting in premature firing. Said devices have other analogous problems that negatively effect the desired quick, clean, frictionless, and obstructionless release of a tensioned bowstring.

For accurate shooting, a device should have a minimum of mechanical members, be symmetrically arranged about a vertical plane through a drawn bowstring, involve a minimum of manual movement to uncock said device, provide comfort and safety for the users fingers and be structurally formed incorporating the aforementioned. The device should operate to effect the manner by which conventional archers use their bare fingers to draw and release a tensioned bowstring absent a mechanical release.

Said conventional manner is achieved by an archer using the index finger to grasp the bowstring in the area immediately above the loaded arrow notch and with the middle and fourth fingers under said notch, thereby, drawn rearward to the anchoring and aiming position to be released therefrom to effect an aspiratory manner of quickly straightening said fingers in a motion that does not torque said bowstring, nor obstructs or alters its path while pushing said arrow to its target.

While many prior art devices exist, none provide a universal device such as the present invention that both the device user and the conventional shooter can use to effect an original aesthetic and conventional manner of shooting a bow and arrow with an ergonomic inertia responsive device that actuates frictionless bowstring release without undue torsion of aid bowstring or non-obstructing and altering the normal path of said bowstring.

SUMMARY OF THE INVENTION

The novel ergonomic designed and operated device of the present invention satisfies the foregoing needs.

In its basic concept the present invention provides a triggerless and buttonless bowstring release in which an archer's original aesthetic and conventional manner of quickly straightening the fingers from a conventional grasp of a drawn bowstring, functions to effect release of said device which will thereafter, utilize inertia to effect frictionless release of a bowstring hook from a cocked string-supporting position to an uncocked string-releasing position.

It is by virtue of the foregoing novel concept that the principal object of this invention is achieved; which is to over coma the aforementioned limitations and disadvantages of prior archery bowstring devices and release methods by creating an ergonomic device and a novel method.

Another important object of the present invention is to provide an adjustable device which is operable by right or left handed archers.

Another important object of the present invention is to provide an adjustable device which can be used by small, medium, or large hand and fingers.

Another important object of the present invention is to provide an ergonomic device comprising a body including a pair of elongated parallel flanges operatively extended forwards from the central area of said body. A bowstring retaining level is pivotably disposed at the distal forward end of said flanges. Said bowstring lever having a bowstring hook support on one end to support a tensioned bowstring when said device is cocked and, on an opposite end a catch means which is operatively releasably engaged and supported by a pawl means.

Another important object of the present invention is to provide an ergonomic inertia responsive device to effect frictionless release of said bowstring. Whereby when said device is released in a manner an archer originally, aesthetically and conventionally releases a tensioned bowstring, said device and integral pivotable means are initially inactive, thereby, said device is rendered without dynamic strength and cannot withstand said bowstring motivity, which, frictionlessly exerts influence on said integral pivotable means to pivot and thereby achieve frictionless release of said bowstring.

Another important object of the present invention is to provide an ergonomic bowstring release device which is pivotal at its base grip member to nullify any residual resistance of said integral pivotable means and said device when the bowstring and said device are released.

It is still another important object of the present invention to provide a tip grip member which is operatively pivotably engaged to the lower end of said base grip member. Said tip grip member is grasped in the manner an archer originally, aesthetically and conventionally grasps a tensioned bowstring to adjoin said grip within said grasp, which secures said tip grip member against pivotal movement. Thereby, said tip grip member operatively and releasably adjoins and restricts a pawl bar lever, against pivoting a pawl means at its end which operatively, releasably engages said bowstring retaining lever, when said device is in cocked position.

Another important object of the present invention is to provide a universal ergonomic device that both the bare finger and the device user archer can utilize alternatingly without restricting said archer's ability to use either as said archer chooses on different occasions. This is very important because said invention is utilized in the manner that an archer effects an original, aesthetic and conventional, release.

Other features of the foregoing and other objects and advantages of this novel ergonomic invention will appear from the following brief description of the drawings offered in connection with the detailed description of the preferred embodiments.

DESCRIPTION OF THE PREFERRED EMBODIMENTS

In accordance with this novel invention it has been found that an inertia responsive archery bowstring release may be provided to permit an archer's original, aesthetic, and conventional manner by which straightening the fingers ergonomically operates said device to effect the frictionless release of a tensioned bowstring from a pivotal bowstring lever member to permit frictionless release of said bowstring without undue torsion and undue influence upon the normal path thereof, and to thus permit an undue influence from said device on the arrows intended trajectory. Other various novel features and advantages of said device in accordance with this invention will become apparent from the following illustrations and description given with references to the various figures of drawings.

BRIEF DESCRIPTION OF THE DRAWINGS

FIGS. 5A and 5B illustrates the use of the device. FIG. 5A shows the device in the archers grasp as seen from above. FIG. 5B shows device in initial response to inertia. FIG. 5C shows the bowstring released from device, absent the safety for clarity. FIG. 5D shows archer's fingers in follow-through position.

FIGS. 6A and 6B illustrates the convertibiliy of the invention by inverting the body member without rotating, from the right-handed use in FIG. 6A to the left-handed use in FIG. 6B.

FIG. 7A shows the base grip in the lower position on the body member.

FIG. 7B shows the base grip in the higher position on the body member.

DETAILED DESCRIPTION OF THE INVENTION

Figure 1:
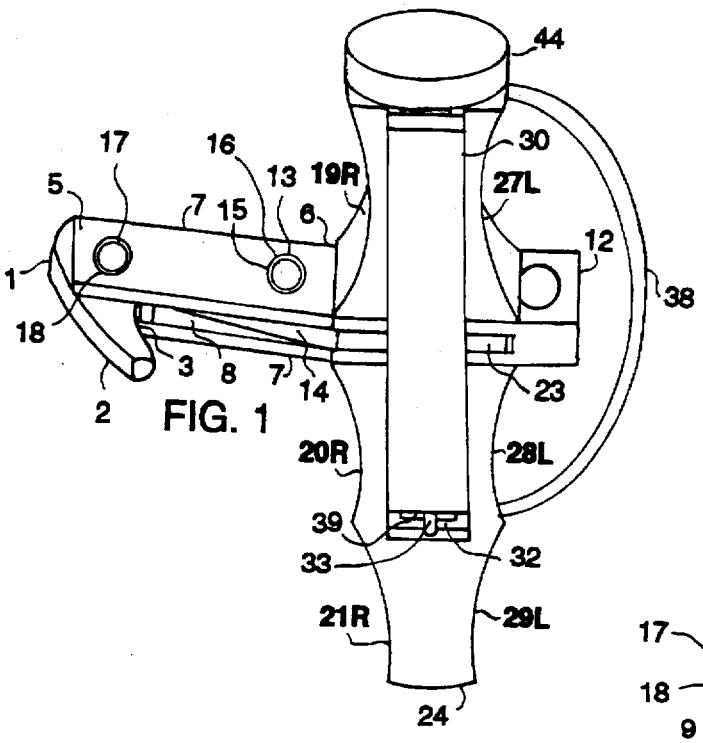
FIG. 1 is a plan drawing of a preferred embodiment of the invention. The device is shown the cocked position of the bowstring lever which supports a tensioned bowstring.
Figure 3:
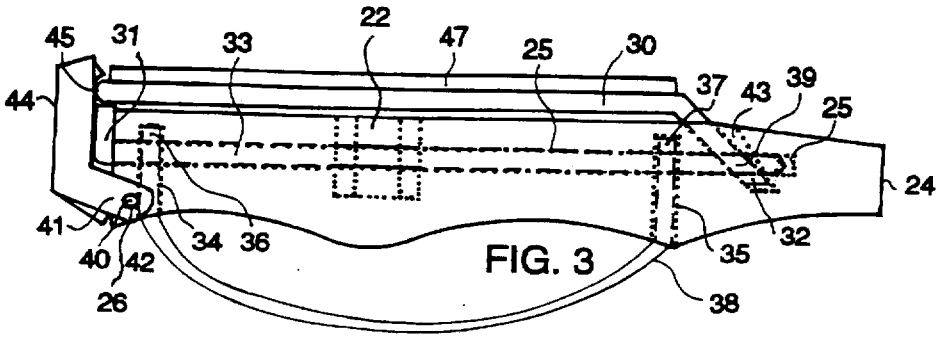
FIG. 3 is a fragmentary plan view in the front elevation without the body and bowstring lever members, and showing the safety engaged position which adjoins the tip grip and base grip member to releasably lock the invention in the cocked position.

Referring now to the plan view shown in FIGS. 1 and 3, tip grip member 30 and the base grip member 24 form a configuration in which said members 30, 24 am releasably pivotal and engaged by an elongated fastener 33 intermediate the ends of base grip 24. Said grip member 24 is shaped generally in the form of a lazy-T, the longitudinally extending base grip member 24 is slideably and releasably engaged by body base member 12 at base grip cavity member 22 in the front lateral area of said base grip member 24. Body base 12 defines forwardly projecting portion 6. To comfortably accept an archers right hand fingers as FIGS. 1 and 7 illustrates, a concave index finger-receiving depression 19R which is contoured to merge with the upper surface of the forwardly projecting body member, and series of ridges and depressions 20R and 21R are formed to receive fingers of the archer. For the left hand fingers the aforementioned configuration of fingers receiving depressions are formed and situated on a diametrically opposed side of an axis, respectively 27L, 28L, 29L. The wrist strap hole 42 adjacent to the lower end of said body base member 12 is for attaching a wrist strap (not shown) to aid in drawing a bowstring rearwardly.

Figure 2:
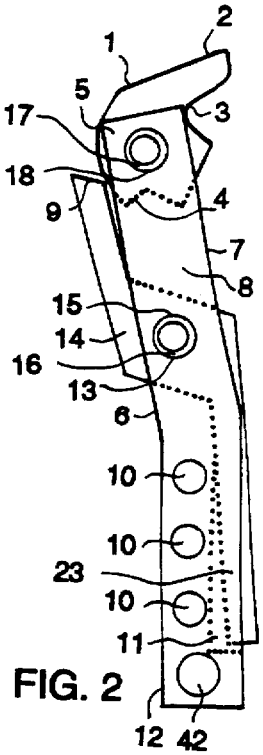
FIG. 2 is a fragmentary side view of the body member, showing the pivoted pawl member and pivoted bowstring lever member in the uncocked position.

FIG. 3 shows a blind cylindrical base grip bore 25 extends downwardly into the top of the base grip member 24 through the top fingers strap cavity, 34 and then extended downwardly into the base grip member 24, then through said base grip cavity 22, and then through the bottom fingers strap cavity 35 being likewise disposed as said top fingers cavity 34, and then through the tip grip cavity 43. A longitudinally extending fastener 33 is slideably and releasably disposed into said bore 25 and is forced through the end 36 of a fingers strap 38 when said strap end 36 is slideably disposed into said strap cavity 34, the said fastener 33 is then slideably and releasably engaged through a selected hole 10 (FIG. 2) in the body base member 12, and then said fastener 33 is forced through the bottom strap end 37 in likewise fashion as the top strap end 36, and then through the tip grip opening 39 when said opening 39 is slideably disposed into the tip grip cavity 43. Hence, said body member 6 and said base grip member 24 with the tip grip member 30 are releasably and slideably engaged to form a lazy-T configuration. And, said fastener 33 has jointly but separately secured said base grip member 24 to said finger strap 38 shown in FIG. 3, to enable an archer's fingers to be placed through the formed loop as illustrated in FIG. 5, which secures said device to said archers fingers which can be quickly straightened to release said device, thereby to effect an original, aesthetic and conventional manner of releasing said bowstring as shown in FIG. 5, without concern for said device filing off said fingers which is an important concern in the follow through motion as illustrated in FIG. 5D for shooting a bow and arrow. Preferably the base grip finger receiving depressions 19R, 20R and 21R and likewise the opposite side 27L, 28L and 29L respectively are of wider bearing surface than the bowstring's surface to thereby permit the application of greater strength force when pulling the bowstring A, rearwardly without causing discomfort to the archers fingers. Said ergonomic device shown in FIGS. 1 and 2 is designed to be pivotal at its base grip member 24 after release of said device. It is so designed to nullify any residual resistance of the integral pivotal means 1 and 14, and members 24 and 30 which effect frictionless activity to allow the bowstring to become disengaged from said ergonomic device.

A flat body configuration 6 comprising 8 space 8 between a pair of forwardly projected parallel flanges 7 from a central portion. From the same central portion a body base member 12 is extended rearwards thereof and comprising a pawl bar member cavity 11 to receive said pawl bar member 23 which will be releasably adjoined to the tip grip member 30. Said body base member 12 also comprises a plurality of longitudinal body base holes 10 as shown in FIG. 2, that transverse said body base member 12. Said body base holes 10 provide for adjustments when a chosen hole 10 is lined up to the base grip bore 25 through which the fastener 33 is slideably and releasably disposed. Said flanges 7 are operatively biased rearwardly to permit said base grip member 24 to be symmetrically arranged about a vertical plane through the drawn bowstring. Said body member 6 can be made of a high strength plastic which can be machined and formed as FIG. 1 illustrates.

A bowstring lever member 1, the function of which will be described in detail hereinafter, is connected intermediate its ends and pivotally to the forward ends 5 of the space within the flanges 7 by means of a pivot cylinder 17 which is made of a wear resistant high strength material illustrated in FIG. 2 as being similar to the pivot cylinder 16, described hereinafter as the flange's axis hole 18. The pivot cylinder 17 is parallel to the flange's, hole 15 of the pawl lever cylinder 16. Said bowstring lever member 1 has one lateral end which is notched to provide a catch means 4 which is provided with a predetermined angle of juncture and to be operatively releasably engaged therefrom, a pawl means 9 to cock and uncock device in FIG. 2. Said bowstring lever 1 has opposite the catch means 4, a recessed or otherwise contoured hook means 2 in which a bowstring support member 3 is disposed to retain and support a tensioned bowstring as shown in FIG. 5.

Figure 8:
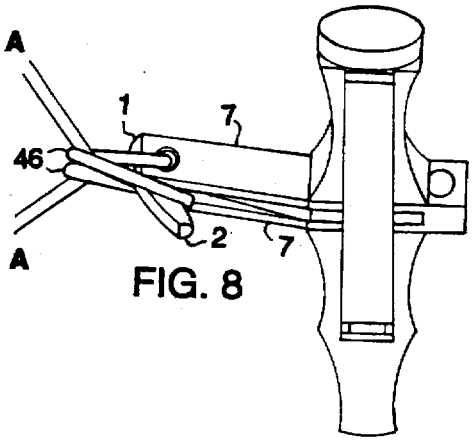
FIG. 8 shows a different embodiment of the invention which is using a rope to releasably engage the bowstring.

Another preferred embodiment provides for a pivot cylinder through which a rope 46 can be connected onto the end of the flanges 7 to therefrom engage the bowstring and release it from the bowstring hook member 2 as shown in FIG. 8.

Therefore, when a tensioned bowstring A shown in FIG. 5 engages and exerts force against the bowstring support member 3, the opposite end of the bowstring lever 1 catch means 4 will exert likewise pressure against a pawl means 9 on one end of a pawl lever 14. The latter being pivoted intermediate its ends and pivotally 13 connected in the space 8 within the flanges 7 by means of a pivot cylinder 16 located rearwards of the bowstring lever.

Figure 4:
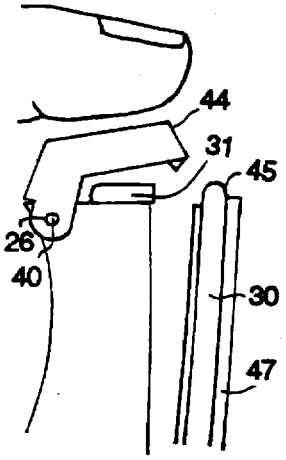
FIG. 4 is a fragmentary plan view of safety in use similar to FIG. 3, showing the safety in the disengaged position which allows the archers fingers to unlock the invention.

The pawl lever member 14 configuration as shown in FIG. 2 has the appearance of a wavelet due to the pawl means 9 being operatively disposed forwardly and the opposite end pawl bar member 23 disposed rearwardly. As shown in FIGS. 3 and 4 safety member 44 is operatively disposed by flanges 41 to overlap onto the top and bottom of the device to allow the proper alignment through the base tip safety bore 26. The safety is removed to expose the top bent end 31 of the fastener 33 which is slideably removed. The body member 6 and the base tip member 24 will disassemble one from the other. The body member 6 is then rotated clockwise 180 degrees and then reassembled.

Refer to FIG. 3 and 7 in order to set a different draw length adjustment for an archer's preference of either comfort or convenience. The device is disassembled as above and one chooses a different body base hole 10 and then reassembles the device, thereby, increasing or decreasing the space between the hook member 2 and the base grip member 24.

The release device in use as illustrated in FIGS. 1, 2 and 6 shows the bowstring lever 1 adjusted from the uncooked position in FIG. 2 to the cocked position in FIG. 1 by rotating the bowstring lever 1 clockwise about the axis of the pivot cylinder 17 to bring the catch 4 end of the bowstring adjacent to the pawl means 9. Then with a counterclockwise rotation of the bowstring lever 1 to seat the catch means 4 to the pawl means 9, the bowstring A is then seated in the hook bowstring support member 3 while the fingers shown in FIG. 5 of the archers hand are grasping the adjoined tip grip 30 and base grip 24 members to thereby lock all integral pivotal members 1, 14, 24, 30 and device shown in FIG. 1 against pivoting which will unduly release the bowstring. When the archer chooses to shoot the arrow from a full draw (not shown) and in the anchored position, the archer to effect an original, aesthetic, and conventional manner attempts to quickly and cleanly straighten the fingers shown in FIGS. 5B and 5C and 5D from the grasp of the device as shown in FIG. 5A as if to let the device fly off the draw hand. Thereafter, initially inertia will imperceptibly maintain the device motionless though the base grip 24 and the tip grip 30 are freed. Thereupon, absent dynamic strength due to loss of structural stability by the device, all integral pivotal means 1, 14, and 30 are unlocked. Thereby the device utilized inertia to unlock the device and allow the straightening fingers to avoid further contact and to provide an obstructionless path of the grip tip 30. The aforementioned is very important to not impede the actuation of the bowstring motivity to frictionlessly exert influence on the bowstring hook 1 to pivot its opposite end catch means 4 to influence unrestrained pivotal grip tip member 30 to pivot at its tip grip cavity 43 juncture. The effect of straightening the fingers simultaneously cause this inertia responsive device and integral pivotal means 1, 14 and 30 to initially remain inactive as shown in FIG. 5B. Thereupon, said bowstring frictionlessly exerts influence on the bowstring hook 2 and the device which is unable to restrain said bowstring's forward motion due to the unlocked integral pivotal means as illustrated in FIG. 2. Whereby, the release of the tensioned bowstring A was initially actuated in the initial instant of release of the device to effect and achieve a quick, and clean release of the bowstring A. A feat of which the accomplished bare fingered archer endeavors to maintain.

Whereby, the previously mentioned bowstring hook 2 will become frictionlessly disengaged from the bowstring and thus avoid undue torsion of the bowstring A and undue influence of the path of the bowstring A. To insure the aforementioned results, the base grip member 24 has been secured to the fingers as shown in FIG. 5A by fingers strap 38 which is operatively disposed as previously described to provide an assurance that said device will not fly off the fingers when release of the bowstring is attempted.

The catch means 4 is supported from pivoting by the pawl means 9 which is kept from pivoting by its opposite end pawl bar member 23, and therein will be restrained from pivoting by the transversely abutted tip grip member 30, intermediate its ends to lock the device's mechanism from pivotal activity.

As best seen in FIG. 3 the lower base of the tip grip member 30 is pivotally disposed and releasably engaged in the intermediate ends area of the base grip member 24 having a forward lateral tip grip cavity 43 into which the lower end of the tip grip member 30 being slideably and releasably disposed to provide pivotal motion comprising an opening 39 through which the base grip bore 25 goes through and into which the fastener 33 is slideably disposed and abutted to the inside of the grip tip catch 32 to connect and secure the previously mentioned members 24, 30. The grip tip member 30 is an operatively elongated tip catch member that extends to be releasably engaged by the safety member 44. The tip grip member 30 includes an elevated bar 47 which affords comfort and adjustability to small or large grasps of the archer's fingers as shown in FIGS. 3 and 4.

The thumb depression mechanism of the safety 44 releasably engages the grip tip catch member 45 as shown in FIG. 3, to thereby restrain the tip grip member to lock the device against undue pivotal activity. The archer lifts the thumb to actuate the release of the safety 44 from the engaged position of the grip tip member 30 to thereby unlock the device as shown in FIG. 4

As shown in FIG. 6 the base grip member 24 is readily converted from the right handed 6A use to the left handed 6D use. The archer must first disengage the safety retaining pin 40 as illustrated in FIG. 3, which is slideably disposed into the bore 42 on the top flange 41 disposed downward and rearwards of the safety 44.

It is also noted that both the bowstring A and the base grip member 24 are symmetrical about a vertical plane which is not deviated from during the correct operation of the invention to enable an archer to attain a high degree of target accuracy by use of the invention as shown in FIG. 5.

The device of the present invention as above described possesses many advantages not heretofore possessed by the prior art. The overall base grip 24 configuration provides for an original, aesthetic and conventional manner to effect the shooting of a bow and arrow whereby, using the present invention does not limit the archer to using only the present invention. Therefore, the archer may train with the present invention to develop the bare fingers technique and/or use the present invention full-time.

Various modifications, changes and alterations can be made in the device of the present invention and in its components and their parameters. All such modifications, changes and alterations as am within the scope of appended claims from part of the present invention.

What is claimed is:

1. A bowstring release comprising:

a base grip member, said base grip member being of a size and shape to be grasped by an archer's fingers and held generally vertically when in use, said base grip member when held vertically including an upper section and a lower section, a bore extending from said upper section and ending in a blind bore in said lower section, a fastener insertable into said bore and extending from said upper section to said blind bore, a generally horizontal slot or cavity formed through said base grip member intermediate said upper and lower sections, said fastener intersecting said cavity;

a tip grip member having a bottom section pivotally attached about a generally horizontal axis toward the lower section of the base grip member, such that the top section is able to move toward and away from the base grip member;

a body member, said body member being received in said cavity of the base grip member and including a rearward portion, and a forward portion extending horizontally from the base grip member, said body member including at least one vertical hole toward the rearward portion through which said fastener passes to pivotally retain said body member in said cavity, said body member comprising an upper and lower flange, a pawl lever pivotally attached between the upper and lower flange, said pawl lever including a rearward branch extending toward the rearward portion of the body member and a forward branch extending toward the forward portion of the body member;

a bowstring support lever including a bowstring retaining hook pivotally attached between the upper and lower flange toward the forward portion of the body member, the pawl lever and the bowstring support lever having complementary pawl surfaces to lock the bowstring support lever in a bowstring retaining position when the pawl lever is forcibly pivoted into engagement with the bowstring support lever, the force of a retained bowstring tending to disengage the pawl lever to allow the bowstring support lever to pivot to a disengaged position, said tip grip member engageable with the rearward branch of the pawl lever such that when the archer grips the base grip member and tip grip member, the tip grip member urges the pawl member into engagement with the bowstring support lever to retain the bowstring; but when the archer relaxes the grip, the tip grip member is able to pivot out of engagement with the pawl lever, to allow the pawl lever to be disengaged to allow the bowstring to be released.

2. The bowstring release of claim 1, further including a finger retaining strap connected to said base grip member.

3. The bowstring release of claim 2, said strap including an upper portion with a hole therethrough, and a lower portion with a hole therethrough, said base member including a generally horizontal upper strap cavity and a generally horizontal lower strap cavity, said bore intersecting said upper and lower cavities, said strap upper and lower portions insertable through said respective upper and lower cavities, said fastener insertable through said holes to retain the strap the base grip member.

4. The bowstring release of claim 1 further including a safety member attached to said base grip member to retain the tip grip member in the position where it is pivoted toward the base grip member.

5. The bowstring release of claim 1 where said body member includes a series of vertical holes toward the rearward portion, said fastener insertable through a selected hole to adjust the distance between the base grip member and body member forward portion.

6. The bowstring release of claim 1 wherein, when in use, and the archer is facing in the direction of arrow travel, the tip grip member is located at the fingertips of the archers draw hand either the left or the right of the archer.

7. The bowstring release of claim 6 wherein the orientation of the base grip member and body member can be reversed to change the location of the tip grip member from the right side to the left or vice versa.

8. The bowstring release of claim 1 further including a bowstring retaining rope intermediate the bowstring and bowstring retaining hook.

9. The bowstring release of claim 8, wherein the bowstring support lever is pivotal on a pivot cylinder, said pivot cylinder being hollow, said retaining rope passing through said hollow cylinder.

* * * * *